US005185634A

United States Patent [19]

Minolta Camera Kabushiki Kaisha

[11] Patent Number: 5,185,634

[45] Date of Patent: Feb. 9, 1993

[54] ELECTROPHOTOGRAPHIC COPYING APPARATUS HAVING CAPABILITY OF INTERRUPTING A COPY OPERATION IN MIDST OF MULTI-COLOR TRANSFER PROCESS

[76] Inventor: Minolta Camera Kabushiki Kaisha, 03, Osaka, Japan

[21] Appl. No.: 435,204

[22] Filed: Nov. 9, 1989

[30] Foreign Application Priority Data

Nov. 11, 1988 [JP] Japan ..... 63-286418
Nov. 11, 1988 [JP] Japan ..... 63-286419
Nov. 11, 1988 [JP] Japan ..... 63-286420

[51] Int. Cl.[5] ..... G03G 15/00; G03G 21/00

[52] U.S. Cl. ..... 355/314; 355/308; 355/327

[58] Field of Search ..... 355/272, 274, 275, 313, 355/314, 326, 309, 327, 308

[56] References Cited

U.S. PATENT DOCUMENTS 3,944,794 3/1976 Reehil et al. ..... 355/309 X
4,099,860 7/1978 Connin ..... 355/314
4,275,958 6/1981 Tachika et al. ..... 355/313
4,365,887 12/1982 Kakitani et al. ..... 355/313
4,477,176 10/1984 Russel ..... 355/319
4,641,954 2/1987 Miyata et al. ..... 355/313
4,655,579 4/1987 Adachi et al. ..... 355/218
4,711,556 12/1987 Abuyama ..... 355/314
4,845,528 7/1989 Aoki et al. ..... 355/314

FOREIGN PATENT DOCUMENTS 0006258 1/1981 Japan .
0140265 7/1985 Japan ..... 355/314
0218667 11/1985 Japan .
62-90673 4/1987 Japan .

*Primary Examiner*—A. T. Grimley
*Assistant Examiner*—Robert Beatty
*Attorney, Agent, or Firm*—Burns, Doane, Swecker & Mathis

[57] ABSTRACT

The electrophotographic copying apparatus permits interrupting a copying operation for changing copying conditions to be inputted in the midst of multi-color transfer process. When an interrupt instruction is inputted the apparatus does not continue its operation, and the copying paper incompletely copied is discharged immediately after the transfer operation in progress so as to proceed to the next operation promptly. Further, the apparatus does not count the discharged paper as a completely copied one so that a user may not be charged.

20 Claims, 12 Drawing Sheets

ELECTROPHOTOGRAPHIC COPYING APPARATUS HAVING CAPABILITY OF INTERRUPTING A COPY OPERATION IN MIDST OF MULTI-COLOR TRANSFER PROCESS

BACKGROUD OF THE INVENTION

1. Field of the Invention

The present invention relates to an electrophotographic copying apparatus such as a full-color electrophotographic copying apparatus which performs multicolor copying of an original document by applying a plurality of image transfer processes on a sheet of transfer paper, and more particularly to access of mode change after a transfer operation is stopped in such an electrophotographic copying apparatus.

2. Description of Related Art

There have been proposed many different techniques for an electrophotographic copying apparatus such as a full-color electrophotographic copying apparatus which performs a plurality of image transfer processes on a sheet of transfer paper. In such an electrophotographic copying apparatus as described above, if a stop key is pressed so as to stop the copying operation during its operation because of any kind of inconvenience, the copying operation is not stopped until the whole transfer process is completed on transfer paper being fed, and when the whole transfer process is completed on the transfer paper, finally the transfer paper is finally discharged, which is counted as copied one. Thereafter, it becomes possible to change the copier's mode such as selecting the number of copier to be made or changing the image density.

In the conventional electrophotographic copying apparatus of such constitution as described above, if an operator is aware that the transfer operation is being performed in the wrong document position or inadequate image density and wants to stop the operation in order to set a new mode, he must wait until the whole transfer process on a sheet of transfer paper is completed and the transfer paper is discharged, which results in a disadvantage that it takes a considerable amount of time for the apparatus to accept a mode change. In addition, since the transfer paper which is being copied in an inadequate mode setting is counted as a copied page, there exists another disadvantage that the user is charged for the incompletely transferred paper.

SUMMARY OF THE INVENTION

The foregoing disadvantages are overcome in accordance with the present invention.

It is a first object of the invention to provide an electrophotographic copying apparatus wherein if a key for stopping the copying operation is pressed before the whole transfer process is completed, the apparatus does not proceed to a new transfer operation and the transfer paper is immediately discharged therefrom, that is, immediately after an instruction to stop the copying operation is inputted, the transfer paper is discharged, whereby the operator's waiting time until the apparatus can accept the next key input is reduced.

A second object of the invention is to provide an electrophotographic copying apparatus wherein if a key for stopping the copying operation of the copier is pressed before the whole transfer process is completed, the apparatus does not proceed to a new transfer operation but interrupts the copying operation immediately so that it can accept a new mode. In other words, immediately after an instruction to stop the copying operation is inputted, the apparatus is ready to receive a new mode setting, whereby the operator's waiting time until the apparatus can accept the next key input is reduced.

It is a third object of the invention to provide an electrophotographic copying apparatus wherein a transfer paper, which is in the transfer process when the copying operation is stopped and is subsequently being discharged, is not counted as a completed copy, so that a user is not charged for the transfer paper being incompletely copied.

The above and further objects and features of the invention will more fully be apparent from the following detailed description with accompanying drawings.

DESCRIPTION OF THE PREFERRED EMBODIMENTS

Referring to the accompanying drawings, preferred embodiments of the present invention will be described below in detail.

Figure 1:
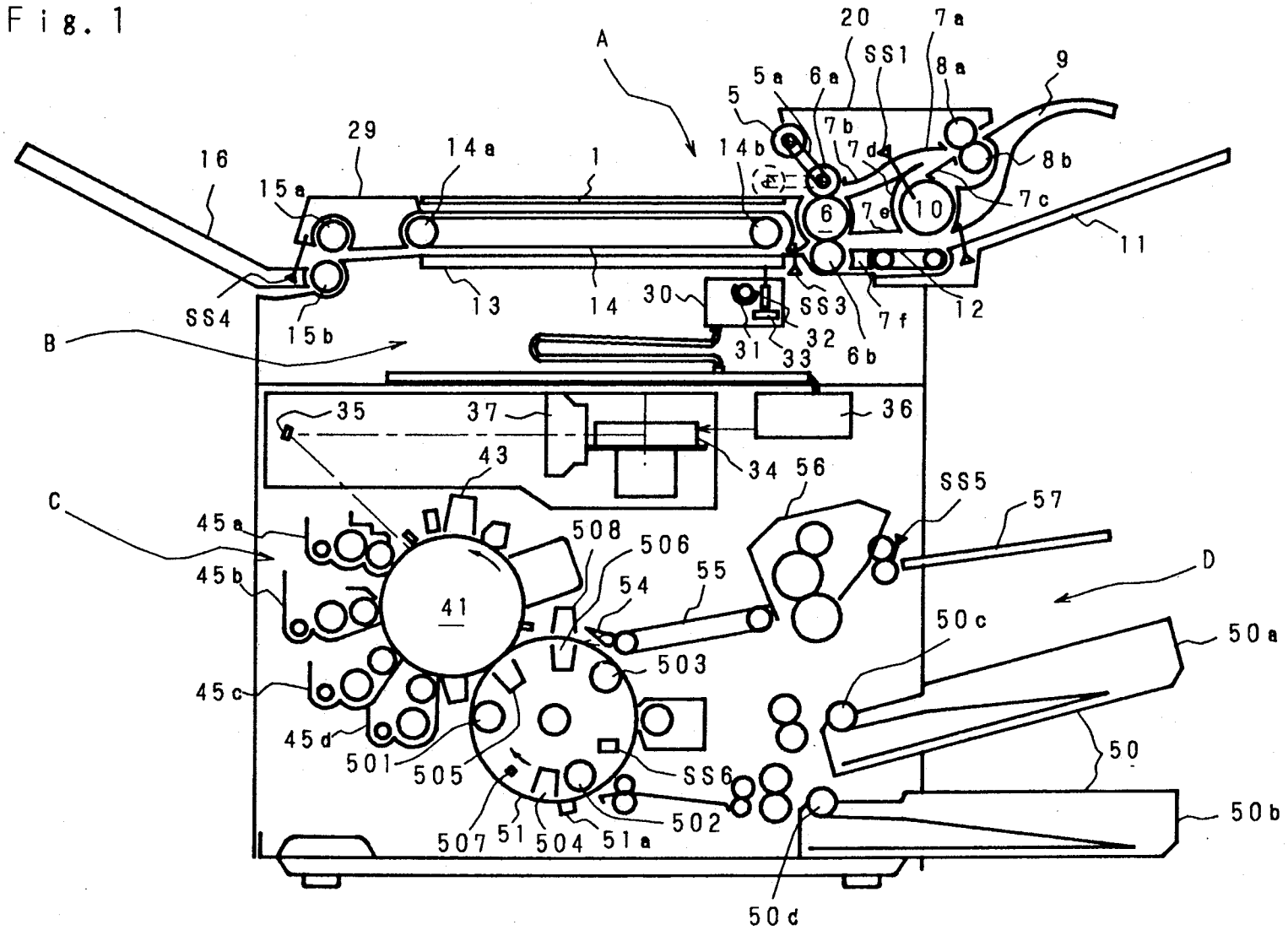
FIG. 1 is a schematically vertical section showing the constitution of an electrophotographic copying apparatus of the present invention.

As shown in FIG. 1, a full-color electrophotographic copying apparatus, which is one embodiment of the invention, is comprised of a document processing system A, an image reader unit B, an image forming unit C, and a transfer paper processing system D.

This copying apparatus is provided with a single document editing mode for transferring a desired area of a document sheet onto a sheet of transfer paper, and a plural document editing mode for transferring respective desired areas of plural documents onto a sheet of transfer paper.

Document Processing System

The document processing system A is comprised of an area setting portion for setting an editing area of a document, a first conveying unit wherein the right side of the document whose editing area has been set is turned over and is conveyed one after another into a document feeder tray 11, and a second conveying unit wherein the document in the document feeder tray 11 is pulled out therefrom onto a document glass plate 13 so as to be transferred and then is carried into a document discharge tray 16.

The area setting portion is comprised of a document tablet 1 which is mounted in the upper portion of an upper frame 29 and a position setting pen (not shown) for designating area which is arranged in the upper portion of a cover case 20. In the area setting portion, the document whose right side is up is adapted to be positioned on the document tablet 1 and its area is designated with the position setting pen.

Figure 2:
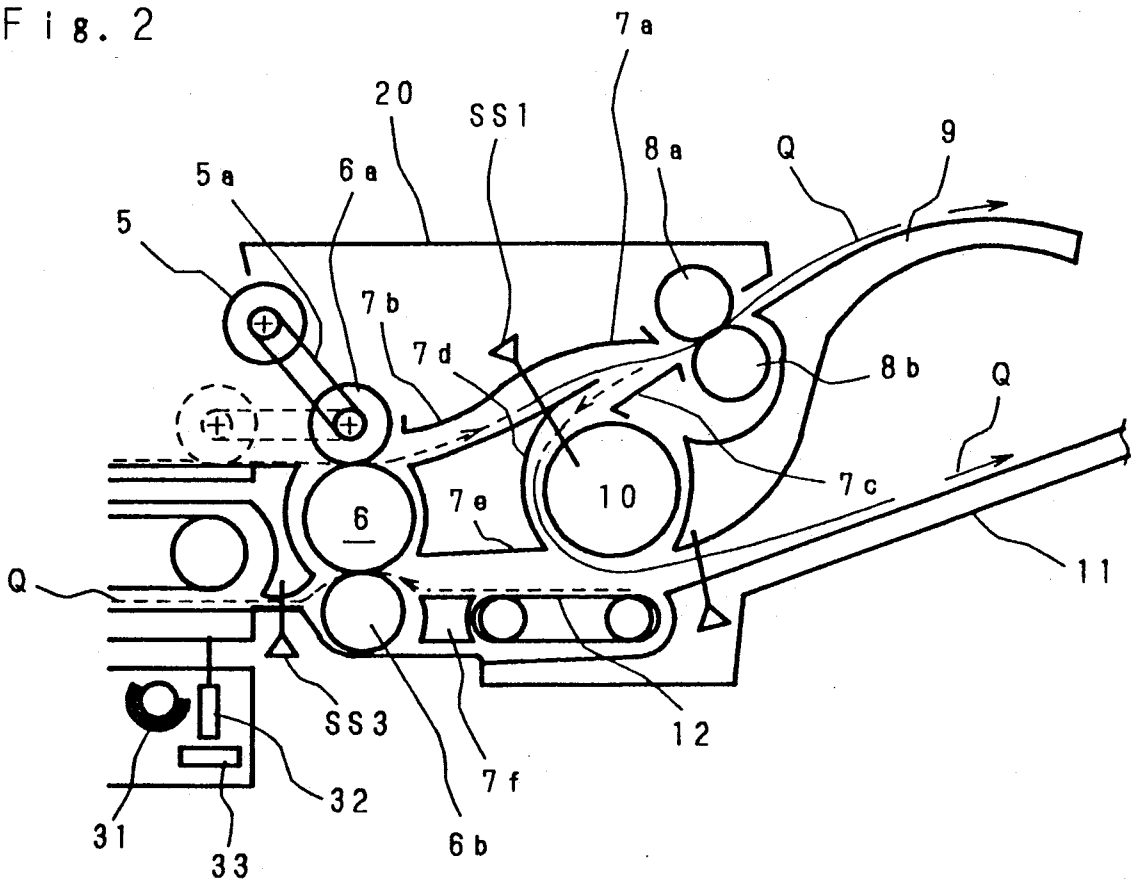
FIG. 2 is a partially enlarged view of a document conveying unit.

The first conveying portion, as shown in FIG. 2, is comprised of a pick-up roller 5 for picking up a document Q whose area has been set from the document tablet 1, a pair of conveying rollers 6, 6*a* for conveying the picked-up document Q toward obliquely above there, guide plates 7*a*, 7*b*, a pair of conveying rollers 8*a*, 8*b*, a guide plate 9, guide plates 7*c*, 7*d* which reversely convey the rear end of the document Q toward obliquely down there and convey it with its right side being turned over into the document feeder tray 11, a U turn roller 10, and the like.

The pick-up roller 5, which is pivotally supported to the tip portion of an arm 5*a* which is rotatably mounted to a rotary shaft of the conveying roller 6*a*, is adapted to be set selectively either in a waiting position as shown by a full line or in a position rotatingly contacting the document Q as shown by a broken line in FIG. 2. When the area setting for the document Q is completed, the pick-up roller 5 is adapted to move down to the position as shown by the broken line and then pick up the document Q so that its right side is up from the document tablet 1, conveying the document Q toward obliquely above there through the conveying rollers 6, 6*a*, guide plates 7*a*, 7*b*, conveying rollers 8*a*, 8*b*, and guide plate 9 which are arranged along the extension of the document tablet 1.

After a predetermined time, that is, the time until the rear end of the document Q is carried from the guide plate 7*b* onto the guide plate 7*c*, has passed, since the front end of the document Q being carried toward the guide plate 9 was detected by a sensor SS1, the conveying rollers 8*a*, 8*b* are reversely rotated so that the document Q is reversely carried through the guide plate 7*d* and U turn roller 10 so that its right side is turned over into the document feeder tray 11.

The sensor SS1 has a contact element in a fin form which is mounted at the tip of a microswitch, and when the front end of the document Q abuts the contact element, the fin moves to detect the document Q. The sensor SS1 is arranged between the conveying rollers 6, 6*a* and the conveying rollers 8*a*, 8*b*, and its contact element is arranged so that it extends from the guide plates 7*a*, 7*b* through the vicinity of the U turn roller 10.

After a predetermined time, that is, the time until the rear end of the document Q is carried into the document feeder tray 11, has passed, since the sensor SS1 detected the rear end of the document Q being carried by the U turn roller 10, the pick-up roller 5 returns to the waiting position as shown by the full line and the next document is positioned on the document tablet 1 so that its area setting can be performed.

The second conveying portion is comprised of a pick-up belt 12 which is mounted in face to face to relation with one end of the document feeder tray 11, guide plates 7*e*, 7*f*, conveying rollers 6, 6*b*, a document glass plate 13, a conveying belt 14 which is neatly stretched around between rollers 14*a* and 14*b* under a platen frame 29 in face to face relation with the document glass plate 13, a pair of conveying rollers 15*a*, 15*b*, the document discharge tray 16, and the like.

When all the documents Q to be color-copied are stacked in the document feeder tray 11, the pick-up belt 12 is driven so that the document stacked in the lowest section of the document feeder tray 11 picked up and is carried through the guide plates 7*e*, 7*f* and conveying rollers 6, 6*b* onto the document glass plate 13 by the conveying belt 14.

A sensor SS3 with the similar constitution as the sensor SS1 is arranged at the downstream side of the conveying rollers 6, 6*b*. After a predetermined time, that is, the time for the rear end of the document Q to be pulled out onto the document glass plate 13, has passed, since the sensor SS3 detected the rear end of the document Q being pulled out from the document feeder tray 11, the conveying belt 14 is reversely rotated. As a result, the document Q which is being pulled out onto the document glass plate 13 is stopped at a predetermined position and is read out by the image reader unit B. Then the conveying belt 14 is positively rotated again so that the document Q on the document glass plate 13 is discharged through the conveying rollers 15*a*, 15*b* onto the document discharge tray 16.

A sensor SS4, which has a similar constitution as the sensor SS1, is arranged at the side where the transfer paper is discharged from the conveying rollers 15*a*, 15*b*. After a predetermined time, that is, the time for the rear end of the document Q to be discharged into the document discharge tray 16, has passed, since the sensor SS4 detected the front end of the document Q, the pick-up belt 12 is driven again so that the next document is pulled out from the document feeder tray 11 and such operations as described above are repeated.

Image Reader Unit

The image reader unit B is comprised of a scanning unit 30 for reading optical images of a document which is set on the document glass plate 13 and an optical system and the like for projecting the images being read by the scanning unit 30 onto a photosensitive drum 41 and exposing them.

The scanning unit 30 is comprised of a light source 31 for irradiating the surface of the document through the document glass plate 13, a lens array 32 for projecting the image of the document onto a CCD linear image sensor 33 which produces four kinds of electric signals each corresponding to the four color components of the document, namely, yellow, magenta, cyan and black, respectively. The optical system is comprised of a laser source 36 which has a laser diode, a polygon mirror 34, a F-$\theta$ lens 37, a plane mirror 35, and the like. In response to the four kinds of electric signals, said laser diode emits laser beams representing the four color components of the original document. The laser beams are projected onto the photosensitive drum 41 through the polygon mirror 34, F-$\theta$ lens 37, and plane mirror 35 one after another.

Image Forming Unit

The photosensitive drum 41 is adapted to be driven and rotated in the direction of the arrow, shown in FIG. 1 that is, counterclockwise. Around the photosensitive drum 41, there is arranged an electrification charger 43 in the position above the rotating and driving area thereof, and at the downstream side in the peripheral direction of the photosensitive drum 41, there are arranged each developing unit 45*a*, 45*b*, 45*c*, 45*d* for yellow, magenta, cyan, and black, respectively in this order.

The optical images whose colors having been separated in the image reader unit B are irradiated onto the photosensitive drum 41 so as to be formed as latent images. At the first rotation of the photosensitive drum 41, the yellow toner supplied from the developing unit 45*a* is adhered onto the electrified portion of the formed latent images so as to be formed as real images, which are transferred onto the transfer paper on a transfer drum 51 as described later. During the second rotation, the magenta toner is adhered onto the formed latent images so as to be formed as real images, which are transferred onto the transfer paper on the transfer drum 51. In the same way, the cyan toner is adhered onto the formed latent images during the third rotation, and the black toner at its fourth rotation one after another so as to be formed as real images, which are transferred onto the transfer paper, respectively.

Paper Processing System

The paper processing system D is comprised of paper feed trays 50*a*, 50*b*, a pair of paper feed rollers 50*c*, 50*d*, the transfer drum 51, a fixing unit 56, a paper discharge tray 57, a discharge sensor SS5, and the like. The transfer drum 51 having on its surface a dielectric screen is supported to be rotatable in a clockwise direction by three supporting rollers 501–503. In the outer periphery of the transfer drum 51, there is provided a chucking claw 51*a* for holding the front end of the transfer paper. In the transfer drum 51, there is provided a chucking solenoid (not shown) for driving the chucking claw 51*a*. In addition in the transfer drum 51, there are fixedly provided an electrification charger 504 which applies static electricity for electrostatically attaching the transfer paper onto the surface of the transfer drum 51, a transfer charger 505 for transferring toner images on the photosensitive drum 41 onto the transfer paper on the transfer drum 51, and a first separation charger 506 for separating the transfer paper which is electrostatically attached to the transfer drum 51 therefrom. In addition, in the transfer drum 51, as a mechanism for detecting a rotation angle of the transfer drum 51, there are fixedly provided a photosensor SS6 and a detecting member 507 which is rotated in synchronism with the transfer drum 51 and is detected once for one rotation thereof by the photosensor SS6. Outside the transfer drum 51, a second separation charger 508 is provided in a position facing the first separation charger 506, and in a position adjacent to the second separation charger 508, there is provided a separation claw 54 which is movable between the full line position and the broken line position as illustrated in FIG. 1. The separation claw 54 is usually positioned in the full line position, and when it separates the transfer paper from the transfer drum 51, it is moved to the broken line position by a solenoid for driving the separation claw (not shown).

In synchronism with the reading operation of the image reader unit B, the front end of the transfer paper, which is pulled out from the paper feed tray 50*a* or 50*b* via the paper feed roller 50*c* or 50*d*, is fixed to the peripheral surface of the transfer drum 51 by the chucking claw 51*a*. Then as the toner real images on the photosensitive drum 41 face the transfer charger 505, the front end of the transfer paper reaches the transfer charger 505 and the toner real images are sequentially transferred onto the transfer paper in the same way as described above. In other words, during the first rotation of the photosensitive drum 41 and the transfer drum 51, yellow toner real images are transferred from the photosensitive drum 41 onto the transfer paper on the transfer drum 51, and in the same way, such color-transfers are performed, as those of magenta during the second rotation, those of cyan during the third rotation, and those of black during the fourth rotation, respectively on the transfer paper. In such a plural document editing mode as described above, when a transfer to a position is completed, the timing is staggered so that the transfer can be performed to the next position, and in the same way as described above, the toner real images from the next document which is formed on the surface of the photosensitive drum 41 are transferred onto the transfer paper.

When the four transfer processes onto a sheet of transfer paper is completed, the chucking claw 51*a* is loosened so that the separation claw 54 can separate the transfer paper from the peripheral surface of the transfer drum 51. The transfer paper is, then, fixed by the fixing unit 56 via a conveying belt 55 and is discharged onto the paper discharge tray 57. At the same time, the discharge sensor SS5 detects the discharge of the transfer paper.

Operation Panel

Figure 3:
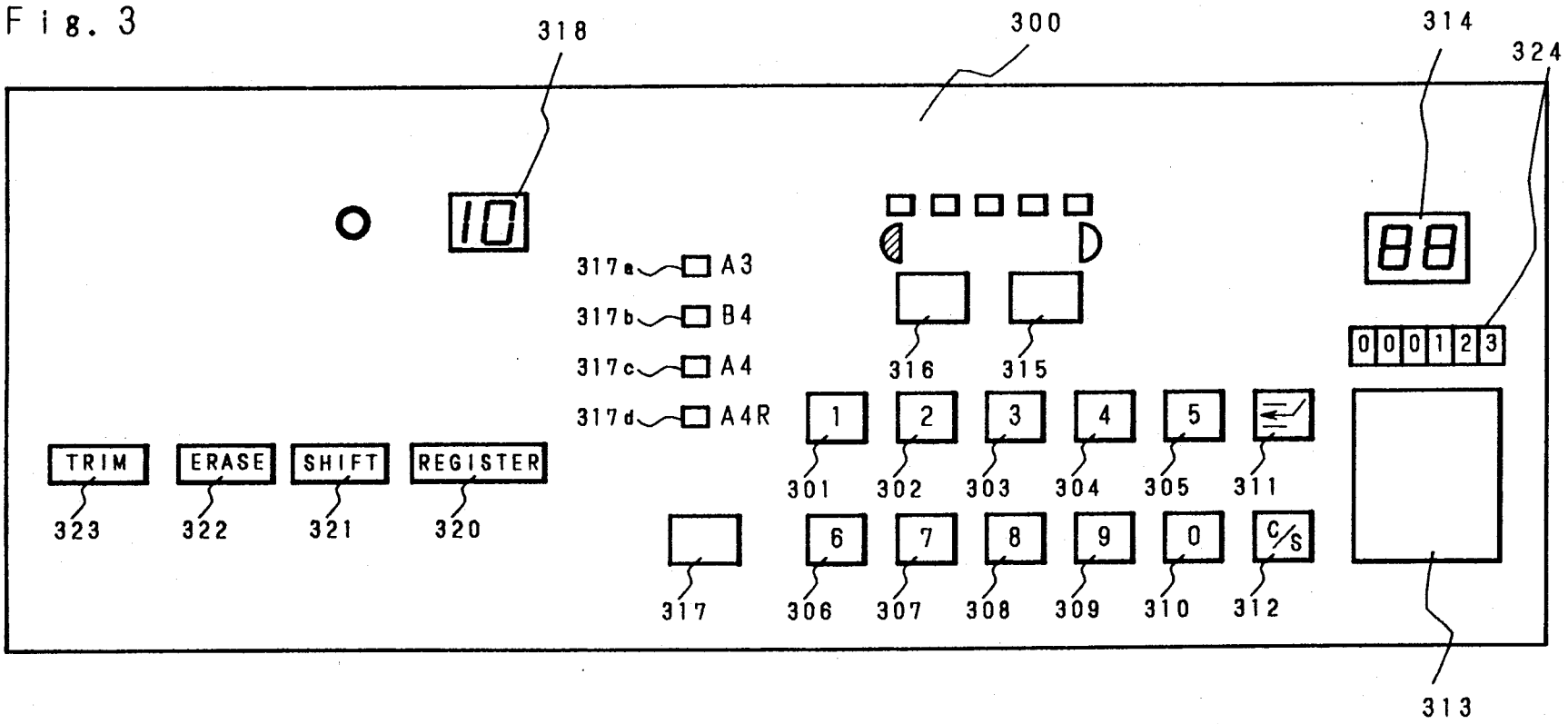
FIG. 3 is a schematic plan view of an operation panel.

FIG. 3 is a plan view of an operation panel 300 in the embodiment. On the right half of the operation panel 300, there are arranged ten keys 301–310 for numbering the number of transfer paper and the like, a print key 313 for starting the copying, process an interrupt key 311 for interrupting the copying, process a clear/stop key 312 for releasing the numbering and stopping the copying, process a transfer paper number display unit 314 for displaying the number of transfer paper, a total counter 324 for summing up and displaying the total number of transfer paper, a density down key 315 and a density up key 316 for setting image density, a paper selection key 317 for selecting paper feed tray 50*a* or 50*b*, and display units 317*a*–317*d* for displaying the size of the transfer paper being stacked in the selected paper feed tray 50*a* or 50*b*.

The left half of the operation panel 300 is provided with input keys for edit copying and display units thereof. On the left half of the operation panel 300, there are arranged a trimming key 323 for instructing a trimming mode to erase an area other than a designated area, an erase key 322 for instructing an erase mode to erase the designated area, a shift key 321 for instructing a shift mode to shift images in the designated area onto a desired position, and a register key 320 for registering area designation for each mode. In addition above the register key 320, there is provided an edit document number display unit 318 for displaying the number of the document whose edit setting has been performed.

When document edit setting is performed, in the single document editing mode, after a desired area of a document sheet is designated by the position setting pen, the trimming key 323, the erase key 322, or the shift key 321 is operated and then the register key 320 is operated to end the setting. And at that time, the edit document number display unit 318 displays "1".

In the plural document editing mode, after a desired area of a first document sheet is designated by the position setting pen, the trimming key 323, the erase key 322 or the shift key 321 is operated and then the register key 320 is operated to end the setting. And at that time, the edit document number display unit 318 displays "1". Then, when the same operation as in the first document sheet is performed for a second document sheet, the edit document number display unit 318 displays "2". The operation is the repeated the same number of times as the number of desired document sheets. Consequently, in the plural document editing mode, the edit document number display unit 318 finally displays the number of documents which have been edited.

Control Circuit

Figure 4:
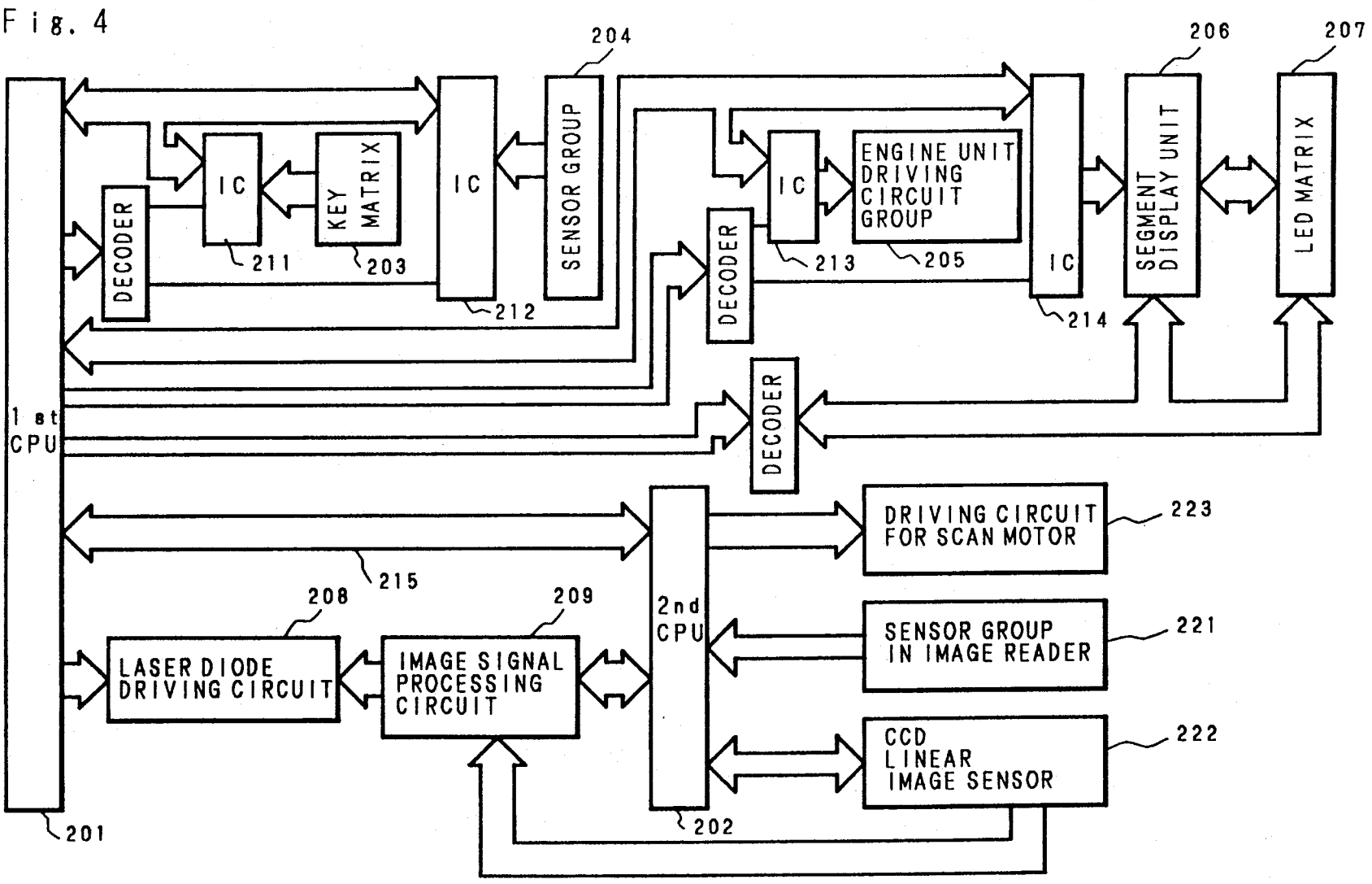
FIG. 4 is a flow diagram of the whole control system.

FIG. 4 is a flow diagram of the control circuit for use in the embodiment. The control circuit is mainly comprised of the document processing system A and the image forming unit C, a first CPU 201 for controlling an engine unit including the paper processing system D, and a second CPU 202 for controlling the image reader unit B.

The first CPU 201 receives signals from of key switch matrix 203 which is mounted on the operation panel 300 through an input expansion IC 211, and receives signals from a sensor group 204 which is provided in the document processing system A, the image forming unit C, and the transfer paper processing system D so as to detect their respective operational states through an input expansion IC 212.

On the contrary, the first CPU 201 outputs, through an output expansion IC 213, control signals to a driving circuit group 205 such as various motors of the engine unit, a solenoid including a solenoid for separation claw, and the total counter. Through an output expansion IC 214, the first CPU 201 outputs control signals to a segment display unit 206 and a various LED display element 207 and to a laser diode driving circuit 208. In addition, the first CPU 201 is connected with the second CPU 202 via a bus 215 so that they can communicate with each other.

The second CPU 202 receives a signal from a sensor group 221 for detecting various states of the image reader unit B and a signal from a CCD linear image sensor 222. The second CPU 202 outputs control signals both to a driving circuit 223 for the scanning motor of scanning unit 30 in the image reader unit B and to an image signal processing circuit 209, and through this image signal processing circuit 209, it also outputs a control signal to the laser diode driving circuit 208.

The functional operation of the present apparatus will now be described below.

Figure 5:
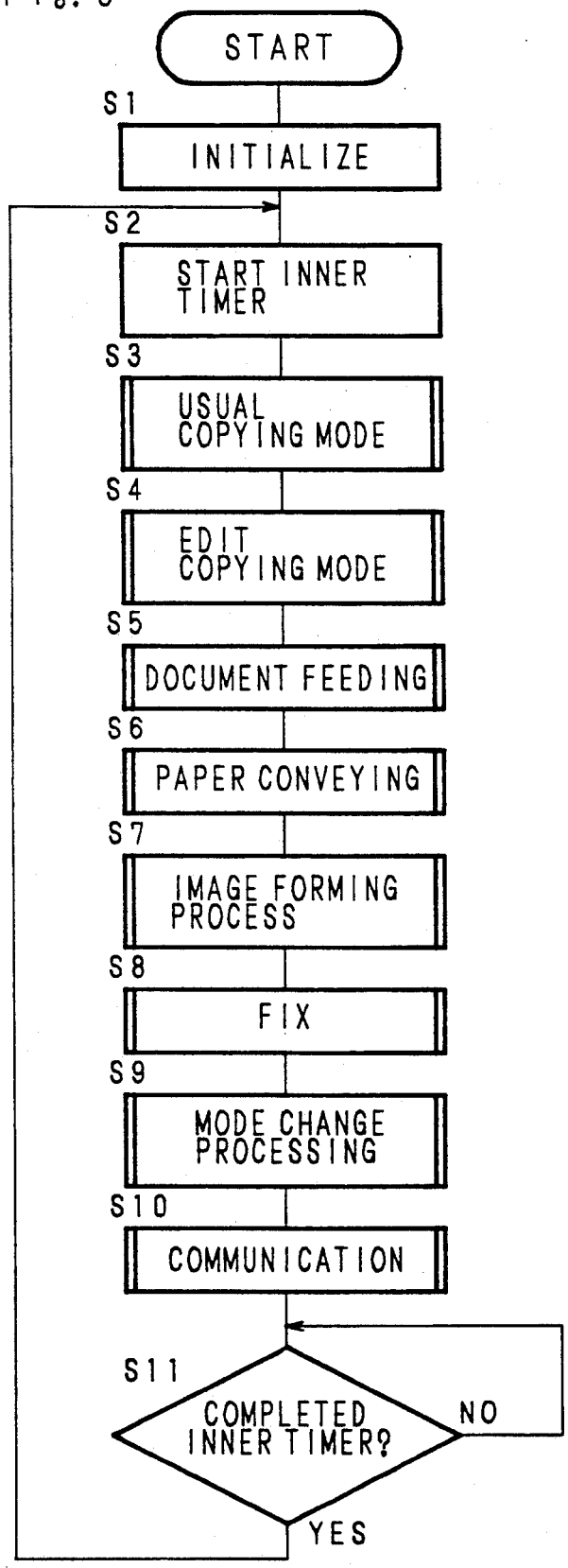
FIG. 5 is a flow chart of a main routine.

FIG. 5 is a flow chart showing a main routine of the first CPU 201. At Step S1, all the states of the various timers, flags, counters, and output ports to be used in the following subroutines are initialized. At Step S2, an inner timer, which regulates one routine time as a minimum time unit of input/output processing, is started. For example, the time of one routine is set to be 10 msec. At Step S3, displays for the operation keys which are arranged on the right half of the operation panel 300 and control of usual copying mode are performed.

At Step S4, displays for the operation keys which are arranged on the left half of the operation panel 300 and control of edit copying mode are performed. At Step S5, a series of controls for conveying a document from the document feeder tray 11 through the document discharge tray 16 are performed. At Step S6, a series of controls for conveying trasfer paper from the paper feed tray 50 through the transfer drum 51 to the paper discharge tray 57 are performed. At Step S7, control of the laser diode driving circuit and control of the periphery of the photosensitive drum 41 such as electrification, developing and so one are performed. At Step S8, temperature control of the fixing unit 56 is performed. At Step S9, mode change processing is performed after a stop key is pressed. At Step S10, control for a serial communication with the second CPU 202 is performed. At Step S11, when the inner timer reaches a predetermined time the operation returns to Step S2. As described above, the period of time to perform Steps S2 through S11 is maintained to be 10 msec at all times.

Figure 6:
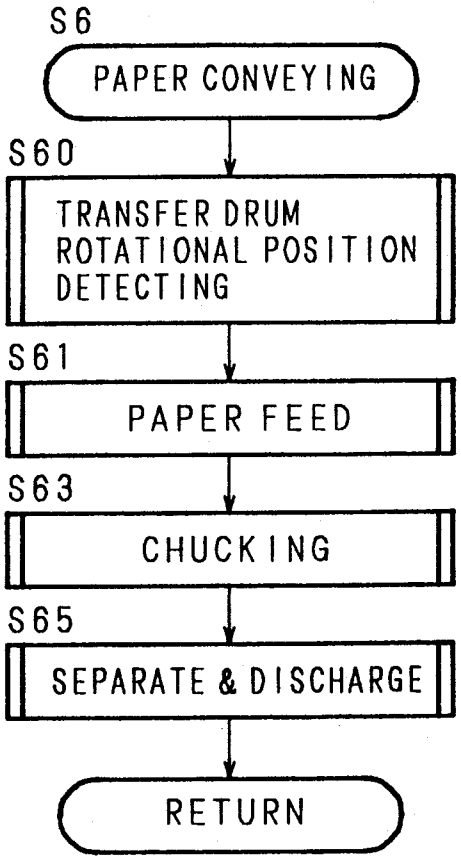
FIG. 6 is a flow chart showing the content of a paper conveying subroutine in FIG. 5.

FIG. 6 is a flow chart showing the content of the paper conveying routine (Step S6). At Step S60, the rotational position of the transfer drum 51 is detected. At Step S61, transfer paper is conveyed from the paper feed tray 50*a*, 50*b* onto the transfer drum 51 one by one. At Step S63, the front end of the transfer paper is conveyed just before the transfer drum 51 is chucked by the chucking claw 51*a* and is rolled up around the transfer drum 51 so as to be held thereon. At Step S65, control for starting to separate the transfer paper from the transfer drum 51 is performed.

Figure 7:
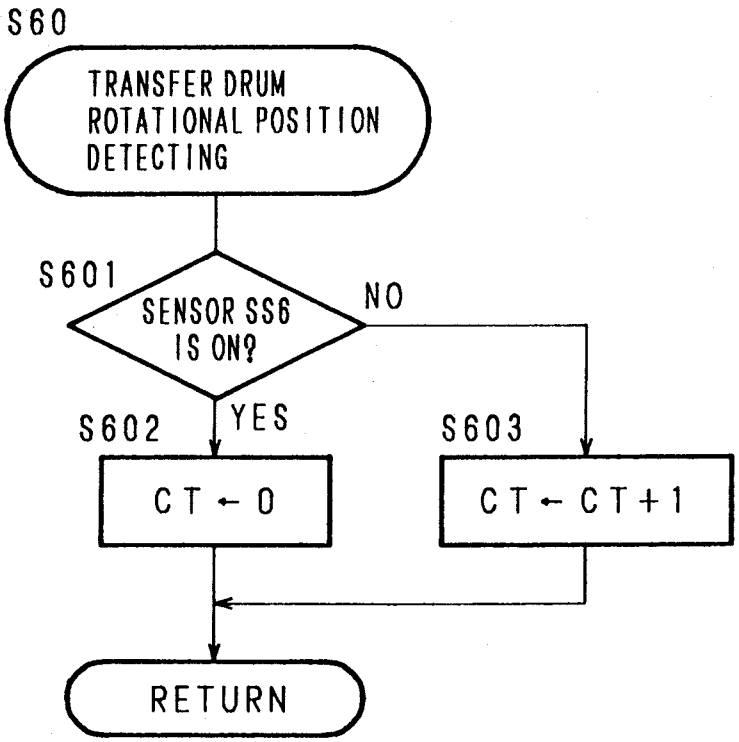
FIG. 7 is a flow chart showing the content of a subroutine of transfer drum position detecting in FIG. 6.

FIG. 7 shows the content of the subroutine for detecting the transfer drum rotational position (Step S60). At Step S601, it is decided whether or not the sensor SS6 detects the detecting member 507 which is mounted to the transfer drum 51. When the sensor SS6 detects the detecting member 507, at Step S602, the value of a position counter CT is reset to 0. On the other hand, when the sensor SS6 does not detect the detecting member 507, at Step S603, the position counter CT is counted up. Since it is adapted that the subroutine of detecting the transfer drum rotational position is executed once in one routine requiring 10 msec and that the detecting member 507 is detected once by the sensor SS6 while the transfer drum 51 is making one rotation, the position counter CT is counted up once in a 10 msec while the transfer drum 51 is rotating, and is reset to be 0 when the transfer drum 51 has made one rotation. Accordingly, the value of the position counter CT shows the present position of the transfer drum 51.

Figure 8:
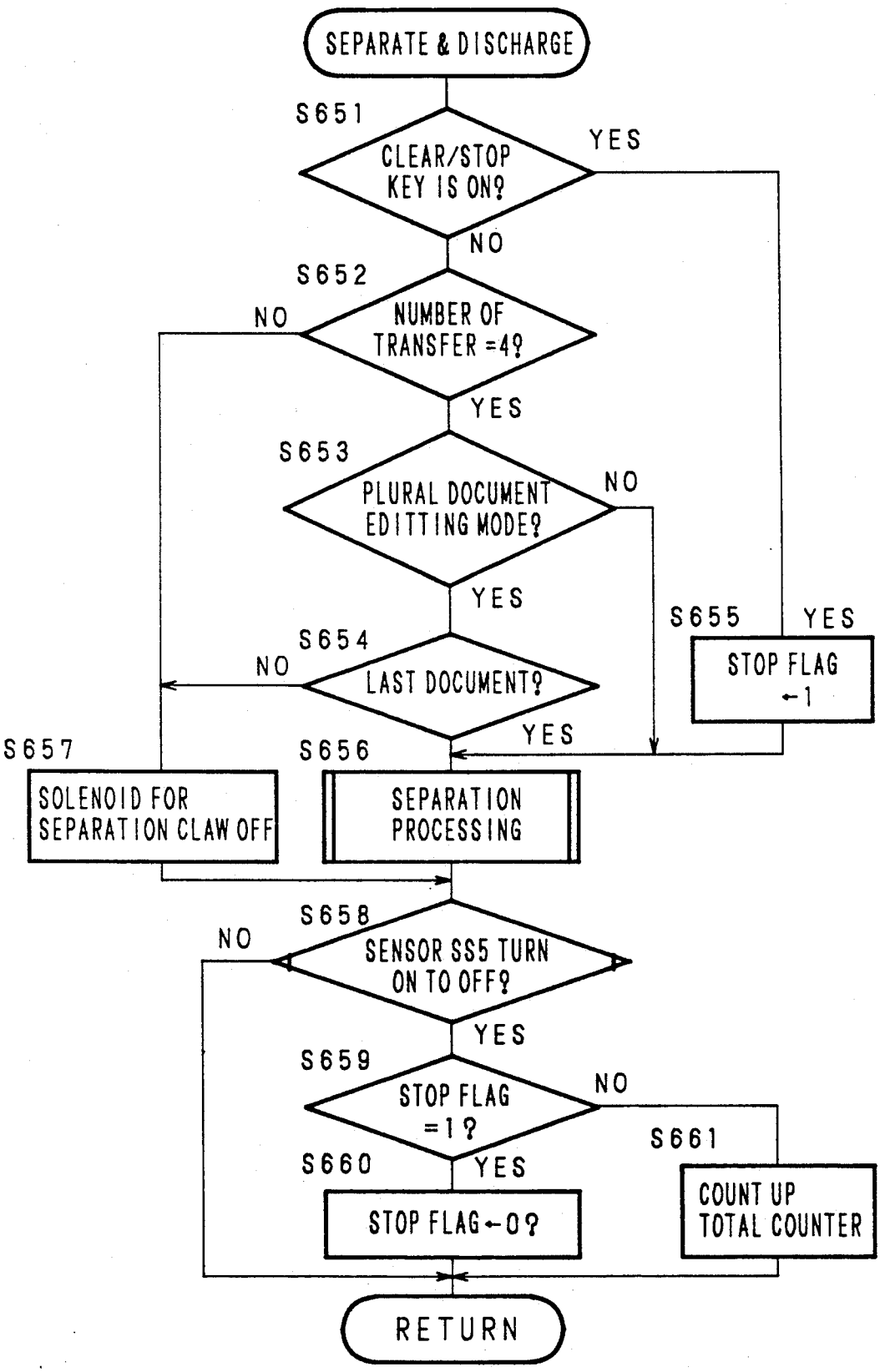
FIG. 8 is a flow chart showing the content of a separation/discharge subroutine in FIG. 6.

FIG. 8 is a flow chart showing the content of the separation/discharge subroutine (Step S65) in FIG. 6. Where the clear/stop key 312 is not in the ON state (Step S651; NO) and transfer operations of such four colors as yellow, magenta, cyan, and black are completed on the transfer paper being chucked (Step S652; YES), it is determined whether or not the mode is for plural document editing (Step S653). When it is the plural document editing mode (Step S653; YES) and the transfer operation is performed from the last document (Step S654; YES), a separation processing subroutine for separating the transfer paper from the transfer drum 51 is executed (Step S656). On the other hand, when it is not the plural document editing mode (Step S653; NO), the separation processing subroutine is executed without any conditions (Step S656).

When the clear/stop key 312 turned ON (Step S651; YES), irrespective of whether the four transfer processes are finished or not, a stop flag is made to show 1 (Step S655) to execute the separation processing subroutine (Step S656). Consequently, when the clear/stop key 312 is turned on, irrespective of the transfer states, the transfer paper is immediately discharged, whereby, the next mode setting can be promptly performed.

Where such conditions as described above are not discovered (Step S652; NO) (Step S654; NO), the solenoid for the separation claw is left in the OFF state (Step S657), and the transfer paper remains held on the transfer drum 51.

When the rear end of the transfer paper, on which the toner real images are transferred, passes through the discharge sensor SS5 (Step S658; YES), and where the stop flag shows 0 (where: 0 at initialization) (Step S659;

NO), the total counter 324 is incremented (Step S661). However, when said stop flag shows 1 (where copying operation is stopped) (Step S659; YES), only the stop flag is cleared (Step S659) and the total counter 324 is not incremented.

Figure 9:
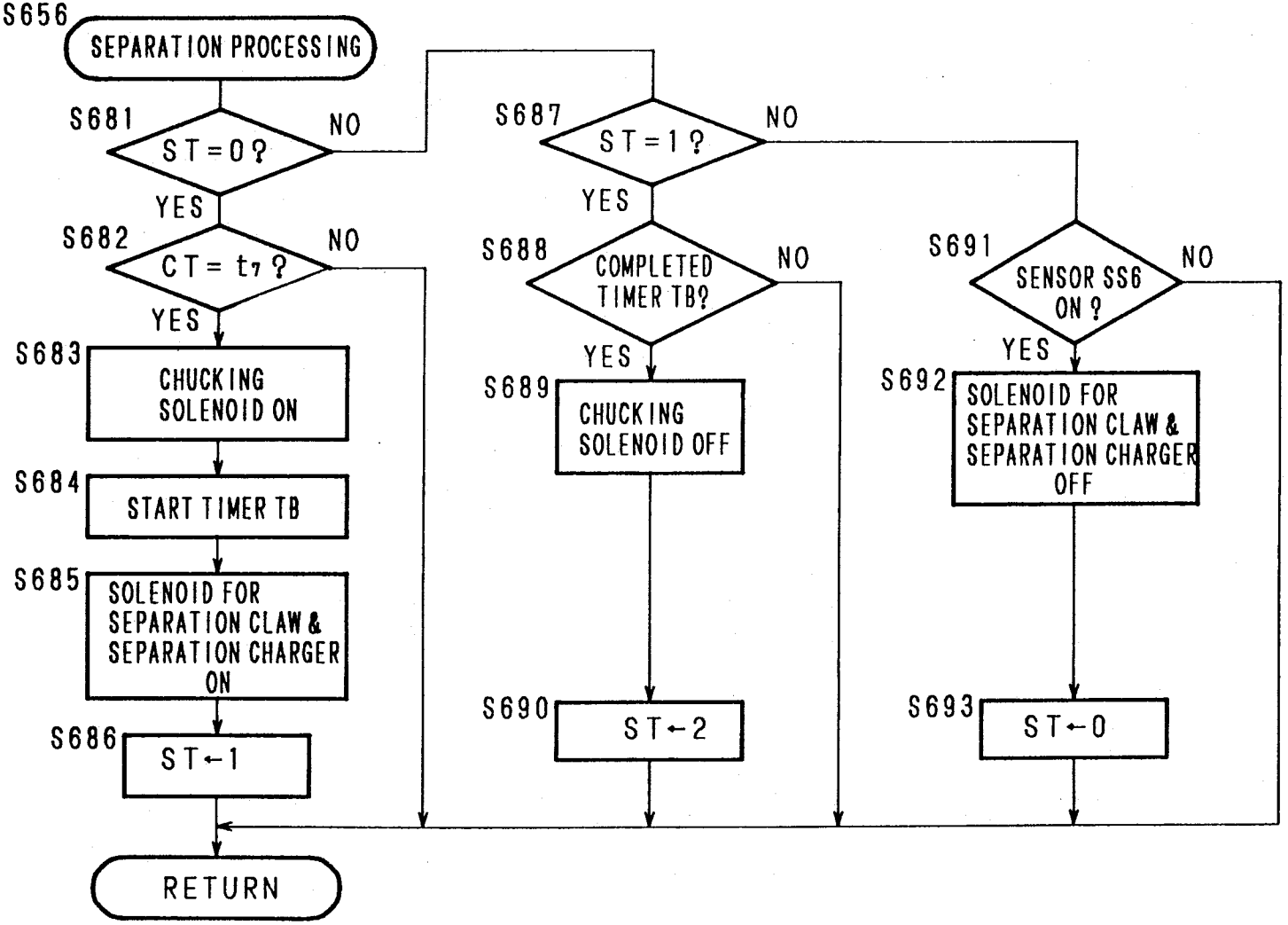
FIG. 9 is a flow chart showing the content of the separation processing subroutine.

FIG. 9 is a flow chart showing the content of the separation processing subroutine of the transfer paper (S656). At Step S681, it is decided whether or not a state counter ST shows 0. The state counter ST is set to be 0 at the initialization.

When the state counter ST shows 0, at Step S682, it is decided whether or not the position counter CT shows a predetermined value t7. The position counter CT shows the predetermined value t7 when the chucking claw 51*a* reaches the position facing the second separation charger 508.

When the position counter CT shows the predetermined value t7, the chucking solenoid is turned ON to release the chucking operation of the transfer paper (Step S683), and the timer TB is started for deciding when to turn the chucking solenoid OFF (Step S684), the solenoid for separation claw and the first and second separation chargers 506, 508 are turned ON (Step S685), and then the state counter ST is made to show 1 (Step S686).

When the state counter ST is not 0, at Step S687, it is decided whether or not the state counter ST shows 1 when the state counter shows 1, at Step S688, it is decided whether or not the timer TB is completed. When the timer TB is completed, at Step S689, the chucking solenoid is turned OFF and at Step S690, the state counter ST is made to show 2.

When the state counter ST shows neither 0 nor 1, at Step S691, it is decided whether or not the discharge sensor SS5 has been turned ON, that is, the front end of the transfer paper reaches the discharge tray 57 when the front end of the transfer paper is detected by the discharge sensor SS5, at Step S692, the solenoid for separation claw and the first and second separation chargers 506, 508 are turned OFF, and at Step S693, the state counter ST is made to show 0.

Figure 10:
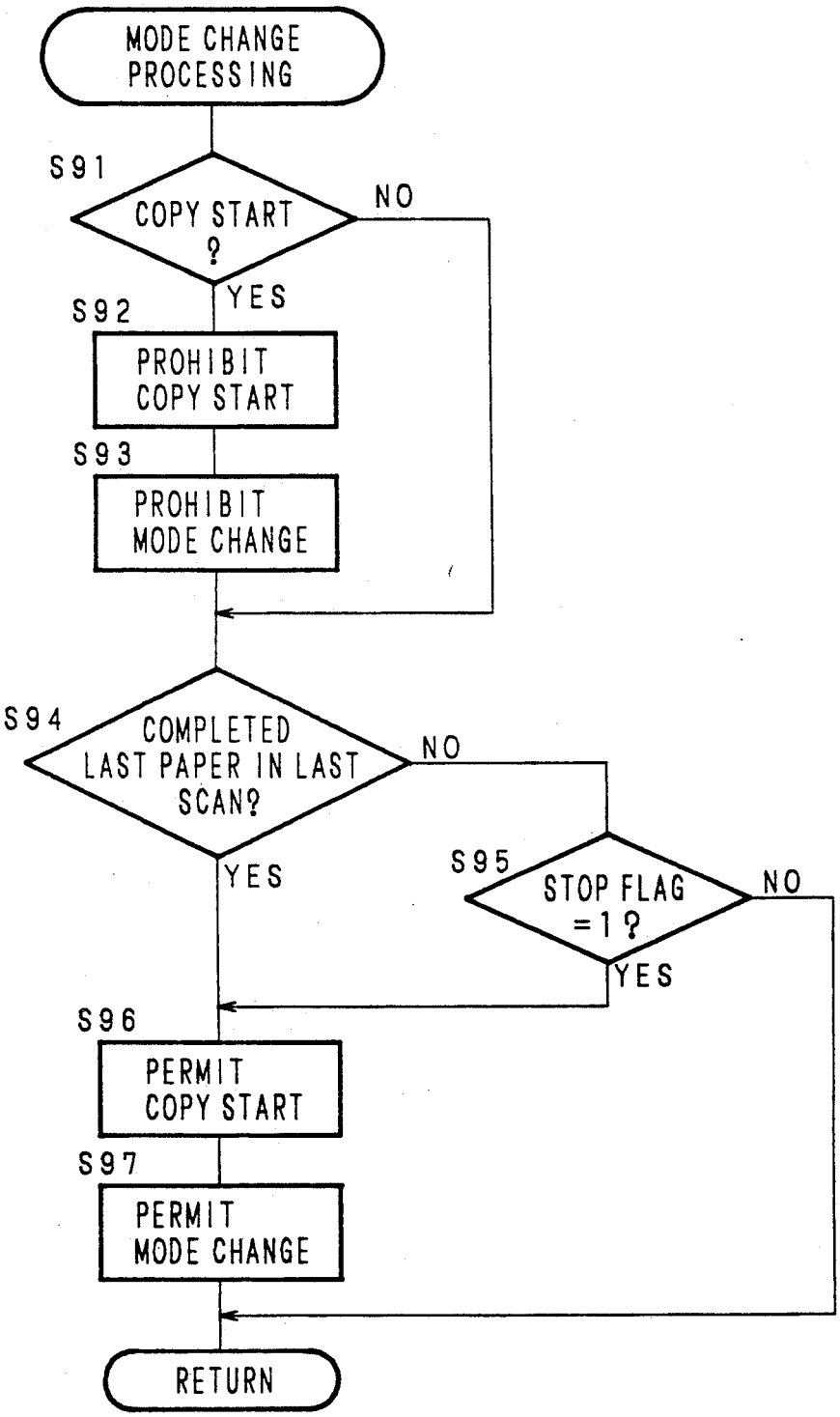
FIG. 10 is a flow chart showing the content of a mode change processing subroutine in FIG. 5.

FIG. 10 is a flow chart showing the content of the mode change processing subroutine (Step S9). When a print key 313 is pressed (Step S91; YES), the copying operation is started, and from that time on, a copy start is prohibited (Step S92) and changing the various copying modes such as selections of image density, paper feed trays 50*a*, 50*b*, the number of transfer paper, or editing mode is prohibited (Step S93). When the last scanning of the last transfer paper is completed (Step S94; YES), or when the last scanning of the last transfer paper is not completed (Step S94; NO) but the stop flag shows 1 (Step S95; YES), the copy start is permitted (Step S96) and the various kinds of copying modes are accepted to be changed (Step S97). When the last scanning of the last transfer paper is not completed (Step S94; NO) and the stop flag shows 0 (Step S95; NO), the operation is returned. In addition, when the clear/stop key 312 is turned ON, the stop flag is set to show 1 (See Step S655 in FIG. 8).

Figure 11:
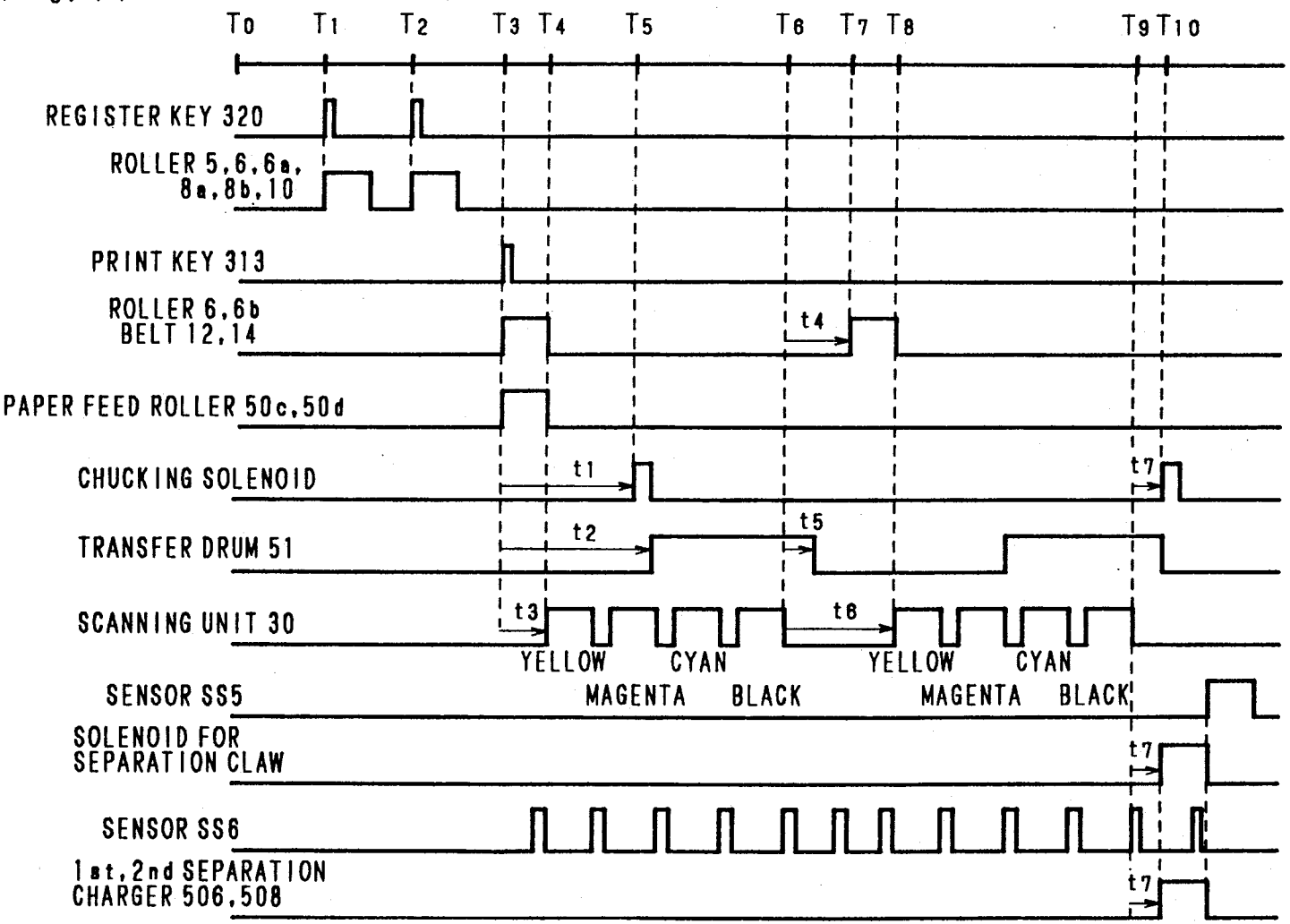
FIGS. 11 and 12 are time charts of the electrophotographic copying apparatus of the present invention.
Figure 12:
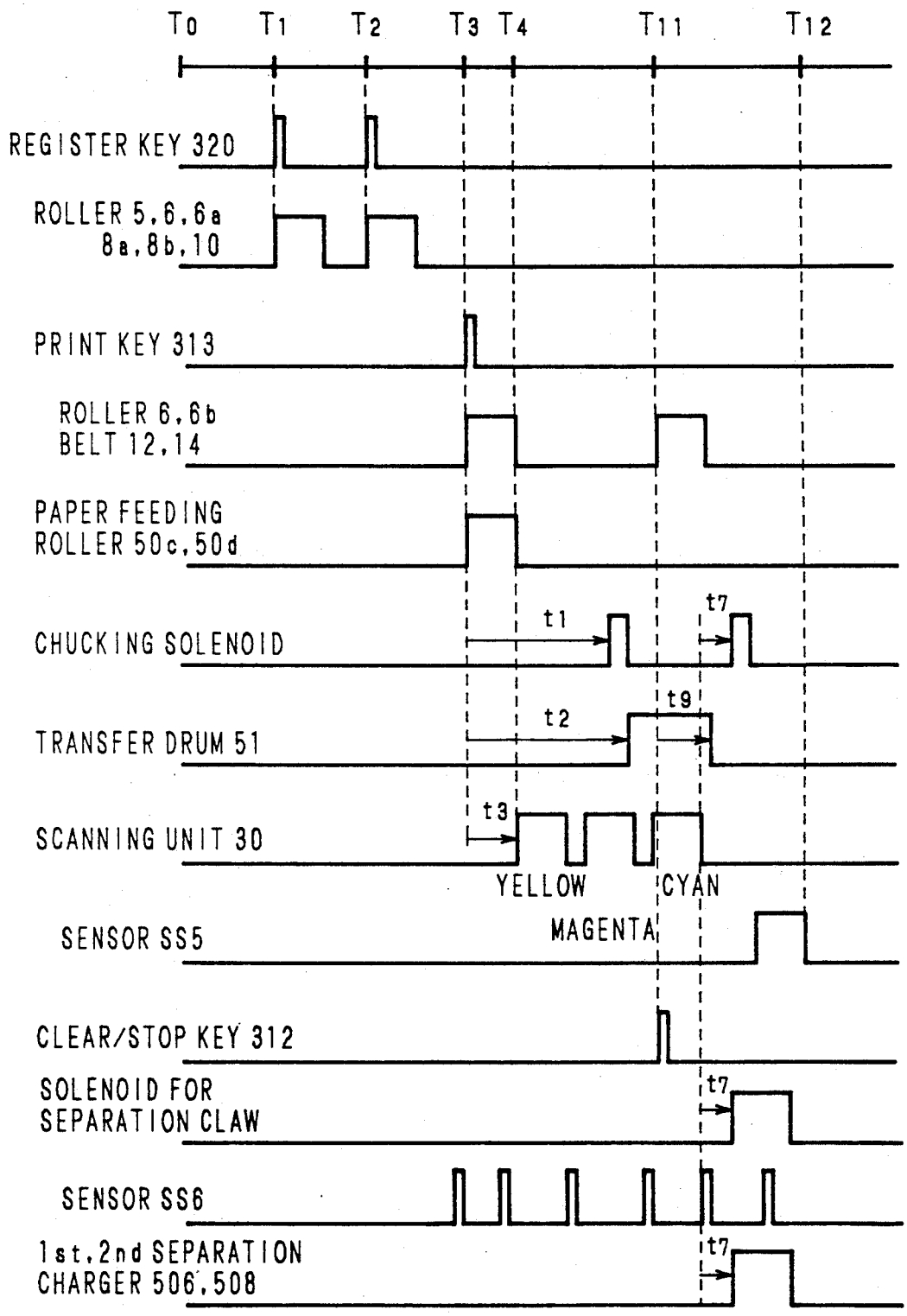

FIGS. 11 and 12 are time charts of sequences in the electrophotographic copying apparatus of the present invention. FIG. 11 is a time chart in the case where the edit copying is performed for two sheets of documents without any interruption. FIG. 12 is a time chart in the case where the clear/stop key 312 is turned ON while copying operation is performed for the first sheet of documents.

At T0 to T1, an operator performs editing operation for the first sheet of documents, and at T1 the register key 320 is inputted so that the first document Q is carried through the pick-up roller 5, the conveying rollers 6, 6*a*, 8*a*, 8*b*, and the U turn roller 10 into the document feeder tray 11. At T1 to T2, the operator performs the editing operation for the second sheet of document, and at T2, the register key 320 is inputted so that the second document Q is carried into the document feeder tray 11 in the same way as the first document.

At T3, when the operator presses the print key 313, the first document is carried from the document feeder tray 11 through the pick-up belt 12, the conveying rollers 6, 6*b*, the conveying belt 14 onto the document glass plate 13 at T3 to T4. At the same time, the transfer paper is pulled out from the paper feed tray 50*a* or 50*b* by the paper feed roller 50*c* or 50*d*, and at T5, the solenoid is turned ON so that the front end of the transfer paper is fixed to the chucking claw 51*a*.

While, at T4, setting of the first document is completed and the scanning unit 30 starts to scan it. This scanning is performed on a sheet of the document by the transfer processes of such four colors as yellow, magenta, cyan, and black. At T6 when the scanning for black developing is completed, the timer is started. After the time t4 has passed in the timer, the second document is conveyed from the document feeder tray 11 onto the document glass plate 13 at T7 to T8, and scanning is performed on the second document (where: the last document in this example) at T8 to T9 in the same way as on the first document. After the predetermined time t7 has passed since T9, that is, at T10, the solenoid is turned ON again and the solenoid for the separation claw and the first and second separation chargers 506, 508 are turned ON so that the transfer paper is separated from the transfer drum 51 and is then discharged onto the paper discharge tray 57. At the same time, the discharged transfer paper is detected by the discharge sensor SS5.

As has been described above, in this embodiment, a total of eight transfer processes are performed on the transfer paper which is held on the transfer drum 51.

Now referring to FIG. 12, the functional operation is described below for the case where the copying operation is interrupted in the midst of the transfer process.

Operations at T0 to T4 are generally the same as in FIG. 11 as aforementioned. For example, at T11, where third scanning is performed on the first sheet of document, assuming that the clear/stop key 312 has been pressed, the first sheet of the document is discharged through the conveying rollers 15*a*, 15*b* into the document discharge tray 16. The second sheet of document is then conveyed onto the document glass plate 13 and then discharged into the document discharge tray 16 in the same way as the first sheet of the document. After performed this third scanning, the scanning unit 30 does not proceed to its new operation. The chucking claw 51*a* of the transfer drum 51 is rotated to the position facing the second separation charger 508 and then the solenoid for separation claw is turned ON so that the chucking claw 51*a* is loosened to separate the transfer paper from the peripheral surface of the transfer drum 51. The transfer paper is carried toward the paper discharge tray 57 in the same way as in the above-mentioned embodiment, and its rear end is detected by the discharge sensor SS5 at T12.

In such embodiments as described above, an explanation has been made on the multi-color electrophotographic copying apparatus which forms color images by four transfer processes. However, the present invention may also be effective in such a copying apparatus which forms color images by two or three transfer processes.

The present invention is applicable not only to the color copying apparatus but also to a single color (monochrome) copying apparatus such as an copying apparatus which scans plural sheets of a document and transfers them plural times so as to obtain one image.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying apparatus comprising:

a photosensitive drum having a photosensitive member on its surface;

a rotatable transfer drum;

transfer paper holding means for holding a transfer paper on said transfer drum;

image forming means for successively forming a plurality of different color toner images on said photosensitive member and transferring all of said different color toner images onto a single surface of said transfer paper held on the transfer drum every time one of said toner images is formed so as to overlap the toner images with each other and thereby obtain a desired image, the number of said different color toner images being predetermined;

first input means for inputting a start instruction of said image forming means;

start control means for starting the operation of said image forming means in response to an inputted start instruction;

automatic termination control means for terminating the operation of said image forming means after said image forming means has completed transferring all of predetermined number of the toner images;

second input means for inputting an interrupt instruction to interrupt the operation of said image forming means during the transferring of a particular one of said toner images; and interrupt control means for interrupting the operation of said image forming means in response to an inputted interrupt instruction, after the completion of the transferring of said particular toner image without forming and transferring remaining ones of said predetermined number of different color toner images.

2. A copying apparatus as set forth in claim 1, wherein said interrupt control means releases the holding operation of said transfer paper holding means in response to said interrupt instruction after the completion of the transfer operation which is in progress, when the interrupt instruction is inputted.

3. A multi-color copying apparatus which obtains multi-color images by sequentially transferring toner images of different colors onto one transfer member comprising, a photosensitive member;

latent image forming means for sequentially forming a latent image onto said photosensitive member a predetermined number of times;

developing means for developing said latent image into a different color toner image every time said latent image is formed;

transfer means for transferring said toner image onto a single surface of one transfer member every time said toner image of a different color is developed;

first input means for inputting a copy start instruction;

start control means for starting the copying operation by operating said latent image forming means, said developing means, and said transfer means in response to an inputted copy start instruction;

termination control means for terminating the started copying operation when said transfer means completes said transfer operations a predetermined number of times;

second input means for inputting an interrupt instruction to interrupt the started copying operation; and interrupt control means for interrupting the started copying operation, in response to an inputted interrupt instruction, after the completion of the transfer operation which is in progress when said interrupt instruction is inputted before said transfer means completes said transfer operations a predetermined number of times.

4. A copying apparatus as set forth in claim 3, further comprising a transfer drum being rotatable; and transfer member holding means for holding said transfer member on said transfer drum.

5. A copying apparatus as set forth in claim 4, wherein said transfer member includes transfer paper.

6. A copying apparatus as set forth in claim 5, wherein said interrupt control means releases the holding operation of transfer paper being held by said transfer member holding means in response to the inputted interrupt instruction after the completion of the transfer operation which is in progress when said interrupt instruction is inputted.

7. A copying apparatus as set forth in claim 5, wherein said transfer member holding means comprises a clamp member for holding the front end of said transfer paper and charging means for charging said transfer paper.

8. A copying apparatus as set forth in claim 6, further comprising removing means for removing said transfer paper from said transfer drum;

said interrupt control means for operating said removing means in response to the inputted interrupt instruction after the completion of the transfer operation which is in progress when said interrupt instruction is inputted.

9. A copying apparatus as set forth in claim 8, wherein said removing means comprises discharging means for discharging the charged transfer paper and a separation claw for separating the discharged transfer paper from said transfer drum.

10. A copying apparatus comprising, a transfer drum being rotatable;

paper feed means for feeding transfer paper onto said transfer drum;

transfer paper holding means for holding the transfer paper being fed by said paper feed means on said transfer drum;

image forming means for forming a desired image on said transfer paper by forming an image a predetermined number of times on one single surface of the transfer paper being held on said transfer drum;

removing means for removing the transfer paper from said transfer drum by releasing the holding operation of said transfer paper being held by said transfer paper holding means after said image forming operation is performed a predetermined number of times;

input means for inputting an interrupt instruction to interrupt the operation of said image forming means; and interrupt control means for interrupting the operation of said image forming means and operating said removing means in response to an inputted interrupt instruction after the completion of the image forming operation which is in progress when said interrupt instruction is inputted before said image forming means completes forming said image a predetermined number of times.

11. A copying apparatus comprising:

an image holding member having an image holding surface;

image forming means having a predetermined number of toner applying means for respectively applying a plurality of different color toners onto the image holding surface of said image holding member and transferring said different color toners onto an image transfer member and for sequentially operating said toner applying means so as to develop toner images on said image holding surface which toner images are transferred onto the image transfer member to form a multi-color toner image;

first input means for inputting a start instruction of said image forming means;

start control means for starting the operation of said image forming means in response to an inputted start instruction;

termination control means for terminating the operation of said image forming means when operations of all the toner applying means are completed;

second input means for inputting an interrupt instruction to interrupt the operation of said image forming means; and interrupt control means for interrupting the operation of said image forming means in response to an inputted interrupt instruction after the completion of the operation of toner applying means which is in progress when said interrupt instruction is inputted before operations of all the toner applying means are completed.

12. A copying apparatus comprising:

image forming means for forming an image on a photosensitive member a predetermined number of times and transferring said image onto a single surface of a transfer member every time said image is formed so as to obtain a desired image;

condition input means for inputting image forming conditions;

first input means for inputting a start instruction of said image forming means;

start control means for starting the operation of said image forming means according to an inputted image forming condition in response to an inputted start instruction;

prohibiting means for prohibiting input of the image forming condition by said condition input means in response to the inputted start instruction;

termination control means for terminating both operations of said image forming means and said prohibiting means when said image forming means completes forming said image a predetermined number of times;

second input means for inputting an interrupt instruction to interrupt the operation of said image forming means; and interrupt control means for immediately stopping the operation of said prohibiting means and interrupting the operation of said image forming means after completion of the transfer operation which is in progress when the interrupt instruction is inputted before said image forming means completes forming said image said predetermined number of times.

13. A copying apparatus as set forth in claim 12, wherein said image forming means forms an image in arbitrary image density and said condition input means inputs said image density.

14. A copying apparatus as set forth in claim 12, wherein said image forming means has a plurality of transfer members in different sizes and forms the image on one of the transfer members, and said condition input means inputs the size of the transfer member on which the image is formed.

15. A copying apparatus comprising:

image forming means for forming an image on a transfer sheet a predetermined number of times;

discharging means for discharging the transfer sheet from said image forming means;

counting means for counting the number of transfer sheets which have been discharged from said image forming means;

input means for inputting an interrupt instruction to interrupt the operation of said image forming means; and interrupt control means for stopping the operation of said image forming means as well as said counting means while allowing operation of said discharging means when the interrupt instruction is inputted before said image forming means completes forming said image said predetermined number of times.

16. A copying apparatus as set forth in claim 15, wherein said transfer sheet includes transfer paper.

17. A copying apparatus as set forth in claim 16, wherein said image forming means comprises a photosensitive drum having said photosensitive member on its surface;

toner image forming means for forming toner image on said photosensitive drum;

a transfer drum being rotatable;

transfer paper holding means for holding said transfer paper on said transfer drum;

transfer means for transferring toner image on said photosensitive drum onto the transfer paper being held by said transfer paper holding means; and removing means for removing the transfer paper on said transfer drum after said transfer means performs said transfer operation a predetermined number of times, said counting means counting the number of transfer paper being removed by said removing means.

18. A copying apparatus as set forth in claim 17, wherein said interrupt control means releases the operation of said transfer paper holding means in response to the inputted interrupt instruction after the completion of the transfer operation which is in progress when an interrupt instruction is inputted.

19. A copying apparatus comprising, an image holding member;

image forming means having a predetermined number of toner applying means for respectively applying a number of different color toners onto said image holding member, and for sequentially operating said toner applying means so as to form a multi-color toner image on said image holding member;

first input means for inputting a start instruction of said image forming means;

start control means for starting the operation of said image forming means in response to an inputted start instruction;

termination control means for terminating the operation of said image forming means when operations of all the toner applying means are completed;

counting means for counting the operation number of said termination control means;

second input means for inputting an interrupt instruction to interrupt the operation of said image forming means; and interrupt control means for interrupting the operation of said image forming means in response to an inputted interrupt instruction after the completion of the operation of the toner applying means which is in progress when said interrupt instruction is inputted before operations of all the toner applying means are completed;

said interrupt control means prohibiting the operation of said counting means in response to the inputted interrupt instruction.

20. A multi-color copying apparatus which forms multi-color images by sequentially transferring different color toner images onto a single surface of a transfer sheet comprising:

a photosensitive member;

first input means for inputting a copy start instruction;

latent image forming means for sequentially forming a predetermined number of latent images onto said photosensitive member;

developing means for sequentially developing each one of said latent images into a different color toner image with a different color toner;

transfer means for sequentially performing a predetermined number of transfer operations wherein said toner images are transferred onto said transfer sheet after each different color toner image is developed;

fixing means for fixing the toner images transferred onto said transfer sheet;

conveying means for conveying the transfer sheet to said fixing means after said transfer means completes said sequential transfer operations;

start control means for starting a copying operation by cooperatively operating said latent image forming means, said developing means, said transfer means, and said conveying means in response to an inputted copy start instruction;

second input means for inputting an interrupt instruction to interrupt the started copying operation; and interrupt control means for interrupting the copying operation, in response to the interrupt instruction, after the completion of the transfer operation being performed when the interrupt instruction is inputted;

wherein said conveying means conveys the transfer sheet to the fixing means whether or not said predetermined number of transfer operations were completed when said interrupt instruction was inputted.

* * * * *

UNITED STATES PATENT AND TRADEMARK OFFICE

CERTIFICATE OF CORRECTION

PATENT NO. : 5,185,634

DATED : February 9, 1993

INVENTOR(S) : Hideo MURAMATSU

It is certified that error appears in the above-identified patent and that said Letters Patent is hereby corrected as shown below:

Title page,
Delete "[76] Inventor: Minolta Camera Kabushiki Kaisha, 03, Osaka, Japan"
and insert item [75] Inventor: Hideo Muramatsu, Osaka, Japan item [73] Assignee: Minolta Camera Kabushiki Kaisha, Osaka, Japan --

Signed and Sealed this

Ninth Day of November, 1993

Bruce Lehman

*Attest:*

BRUCE LEHMAN

*Attesting Officer*

*Commissioner of Patents and Trademarks*